US008029185B2

(12) United States Patent
Faucher et al.

(10) Patent No.: US 8,029,185 B2
(45) Date of Patent: Oct. 4, 2011

(54) APPARATUS FOR SECURING AND ADJUSTING A WATCH STRAP

(75) Inventors: Xavier Faucher, Benesse Maremne (FR); Geoff Sykes, Biarritz (FR); Sean Kelly, Aliso Viejo, CA (US)

(73) Assignee: Quiksilver, Inc., Huntington Beach, CA (US)

( * ) Notice: Subject to any disclaimer, the term of this patent is extended or adjusted under 35 U.S.C. 154(b) by 36 days.

(21) Appl. No.: 12/474,220

(22) Filed: May 28, 2009

(65) Prior Publication Data

US 2010/0302914 A1 Dec. 2, 2010

(51) Int. Cl.
*G04B 37/14* (2006.01)
*A44C 5/14* (2006.01)

(52) U.S. Cl. ..... 368/282; 24/265 WS; 224/164

(58) Field of Classification Search ..... 368/281–282; 224/164, 170, 174; 24/265 WS
See application file for complete search history.

(56) References Cited

U.S. PATENT DOCUMENTS

| | | | | | |
|---|---|---|---|---|---|
| 4,178,751 | A | * | 12/1979 | Liautaud | 368/281 |
| 4,198,732 | A | | 4/1980 | Rieth et al. | |
| 4,229,862 | A | | 10/1980 | Kubelka | |
| 4,332,061 | A | | 6/1982 | Rieth et al. | |
| 4,615,185 | A | * | 10/1986 | Bollinger | 63/1.13 |
| 4,796,337 | A | | 1/1989 | Marxer | |
| 4,941,236 | A | * | 7/1990 | Sherman et al. | 24/303 |
| 4,977,614 | A | * | 12/1990 | Kurcbart | 455/193.1 |
| 5,134,724 | A | * | 7/1992 | Gehring et al. | 455/274 |
| 5,179,733 | A | * | 1/1993 | Matsui | 455/344 |
| 5,572,747 | A | | 11/1996 | Cheng | |
| 6,003,714 | A | * | 12/1999 | Buermann | 220/270 |
| 6,256,847 | B1 | * | 7/2001 | Manley et al. | 24/593.11 |
| 2003/0182770 | A1 | * | 10/2003 | Koshoji | 24/265 WS |

* cited by examiner

*Primary Examiner* — Sean Kayes
(74) *Attorney, Agent, or Firm* — Snell & Wilmer L.L.P.

(57) ABSTRACT

The disclosure generally relates to an apparatus for securing and adjusting a watch strap. In an exemplary embodiment, the disclosure relates to a wrist watch having a watch strap closing system that allows a watch strap with saw teeth to be locked and secured in place by a locking mechanism having complimentary saw teeth. The watch strap can move in one direction in order to tighten the watch strap around the user's wrist, but is prevented from moving in an opposite direction. To release or loosen the watch strap, the user can apply pressure to disengage the locking mechanism.

6 Claims, 10 Drawing Sheets

APPARATUS FOR SECURING AND ADJUSTING A WATCH STRAP

BACKGROUND

1. Field of the Invention

The present invention relates to means for securing and adjusting a free end of a strap, bracelet, band, collar, and the like. More particularly, the invention involves an adjustable locking system for wristwatch straps and bands.

2. Related Art

Typically, straps of wristwatches are opened and fastened by using devices such as buckles or clasps. The application of one of these fastener devices depends often on the material from which the watch strap is made. For example, a watch strap made from soft material like leather is fastened by actuating a buckle. By contrast, a watch strap made from a rigid or metallic material is often fastened by snapping a clasp.

A watch strap having a buckle is fastened in several stages. First, an end portion of the watch strap is inserted into a first loop, then a tongue of the buckle is engaged in a strap hole and finally the buckle is fixed by inserting the end portion of the watch strap into a second loop of the buckle. The end portion is secured by sliding its end in a guide loop of the watch strap.

One disadvantage of a watch strap with a buckle is that the soft strap material, such as leather, may become damaged over time from the stress and pressure of inserting and removing the strap holes into the tongue of the buckle. This can affect the visual qualities of the watch strap, as well as cause the watch strap to eventually tear or break.

A watch strap having a clasp, by contrast, is snapped in one or two stages by fixing the clasp to a stud of the watch strap. Some clasps are quite secure when closed properly; however, they are not easily manipulated into the proper closed configuration, or readily opened intentionally. Others clasps, which are handled readily with one hand, as a watch strap clasps must be, do not provide a high degree of security when closed. Furthermore, to adjust watches having a clasp, a watch specialist is typically required to remove links in the strap.

Therefore, a need exists for a watch strap device that is adjustable and securable and that eliminates the above-mentioned drawbacks of conventional methods and devices.

SUMMARY

In one embodiment, the disclosure relates to a wristwatch, comprising: a watch housing having a first portion, second portion, and a top portion, the top portion having a time display, the second portion having an opening; a watch strap having a first end and a second end, the first end connected to the first portion of the watch housing, the second end configured to be inserted through the opening in the a first direction, the second end having a first interlocking member; and a locking mechanism integral with the second portion of the watch housing, the locking mechanism pivotable between a locked position and an unlocked position, the locking mechanism having a second interlocking member configured to lock with the first interlocking member when the locking mechanism is in the locked position, the locking mechanism configured to prevent the second end of the watch strap from moving in a second direction opposite the first direction when the locking mechanism is in a locked position.

In another embodiment, the disclosure relates to a watch strap adjusting device, comprising: a watch strap connection box attached to a first watch strap, the watch strap connection box having an opening, the opening configured to receive a second watch strap having a first interlocking member; and a depressable member mounted on the watch strap connection box, the depressable member pivotable between a locked position and an unlocked position, the depressable member having a second interlocking member configured to engage the first interlocking member of the second watch strap when the depressable member is in the locked position, the depressable member configured to disengage the first interlocking member from the first interlocking member upon an application of pressure to the depressable member.

In still another embodiment, the disclosure relates to a wristwatch, comprising: a watch housing having a first portion and a second portion, the second portion having an opening; a watch strap having a first end and a second end, the first end connected to the first portion of the watch housing, the second end configured to be inserted through the opening in a first direction, the second end having a first interlocking member; a locking mechanism positioned within the watch housing, the locking mechanism having a second interlocking member, the second interlocking member configured to lock with the first interlocking member, the locking mechanism configured to prevent the second end of the watch strap from moving in a second direction opposite the first direction when the second interlocking member is locked with the first interlocking member; and a depressable member positioned adjacent to the locking mechanism, the depressable member configured to unlock the second interlocking member from the first interlocking member upon an application of pressure to the button.

BRIEF DESCRIPTION OF THE DRAWINGS

These and other embodiments of the disclosure will be discussed with reference to the following exemplary and non-limiting illustrations, in which like elements are numbered similarly, and where.

DETAILED DESCRIPTION

Figure 1:
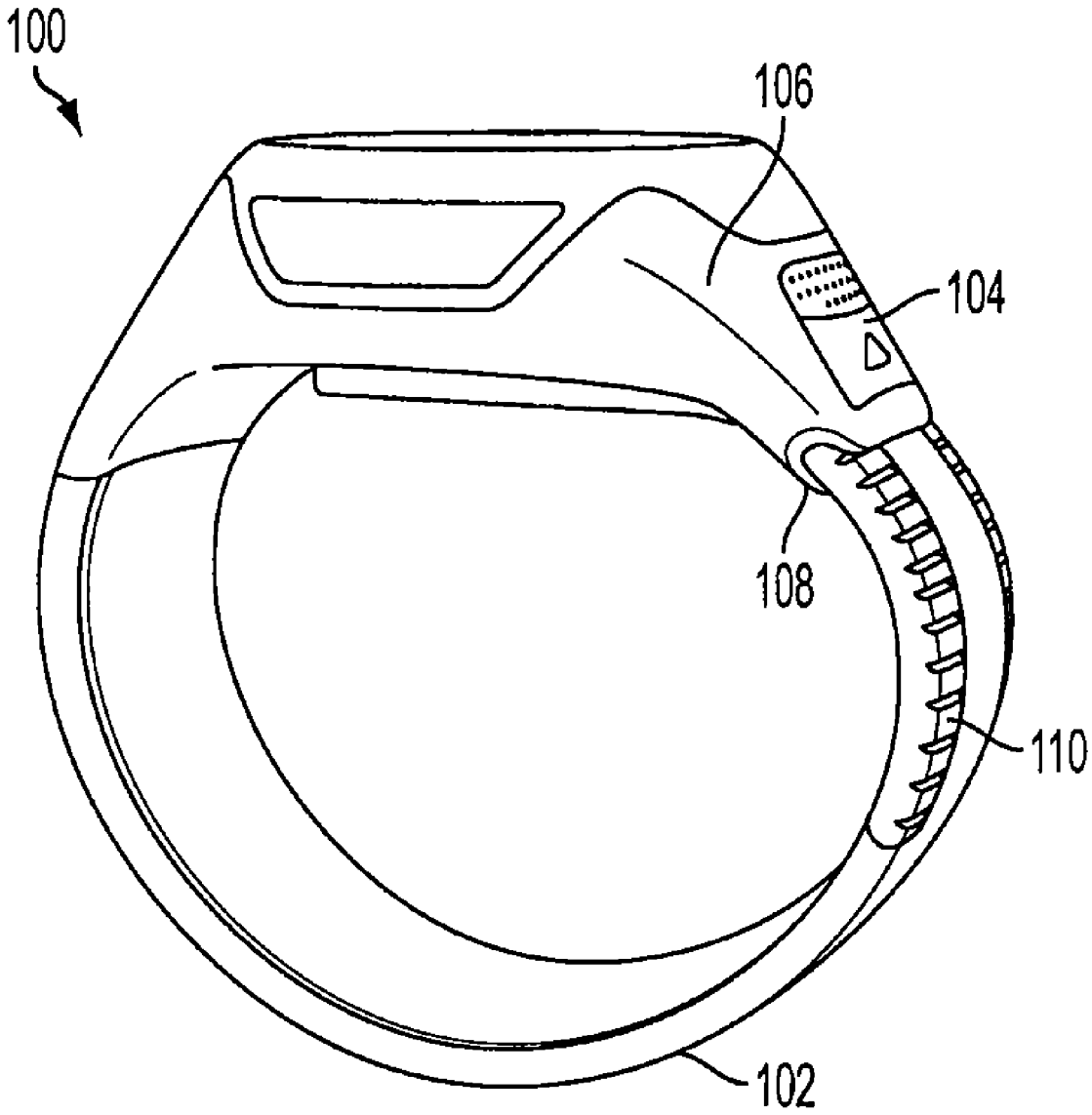
FIG. 1 is a perspective view of a watch having a strap closing system according to an embodiment of the invention.

FIG. 1 is a perspective view of a watch 100 having a strap closing system according to an embodiment of the invention. The watch 100 includes a watch strap 102, a watch housing 106, and a depressable member 104. In one embodiment, only one watch strap 102 is utilized. The watch strap 102 includes teeth 110 along a portion of the watch strap 102. The teeth 110 are interlocking members configured to lock with complimentary teeth with a locking mechanism (described in FIGS. 4 and 5) located within the watch housing 106. The watch housing 106 includes an opening 108 that allows the watch strap 102 to be inserted within the watch housing 106. The watch housing 106 can further include a bezel and a time display.

In an embodiment, the watch strap 102 is made from a semi-rigid or rigid plastic or rubber material, such as, for example, thermoplastic polyurethane. The watch strap 102 and the watch housing 106 can be a single molded piece, or alternatively, the watch strap 102 can be an independently piece that is attached to the watch housing 106. In another embodiment, the watch strap 102 is made from a flexible or semi-flexible metal mesh, such as, for example, stainless steel wire.

In an embodiment, the depressable member 104 is located on the watch housing 106. The depressable member 104 is a depressable member that allows the watch strap 102 to be removed from the watch housing 106 by disengaging the locking mechanism within the watch housing 106 from the teeth 110 of the watch strap 102. The depressable member 104 is mounted on the watch housing 106 so that the depressable member 104 and can be depressed to disengage the locking mechanism from the teeth 110. In an embodiment, the depressable member 104 can be depressed by a user's finger. In another embodiment, the depressable tab can be located on another portion of the watch housing 106 or on the watch strap 102. The depressable member 104 may be a button, knob, lever, switch, sliding mechanism, tab, or any other means that can disengage the locking mechanism from the teeth 110.

Figure 2:
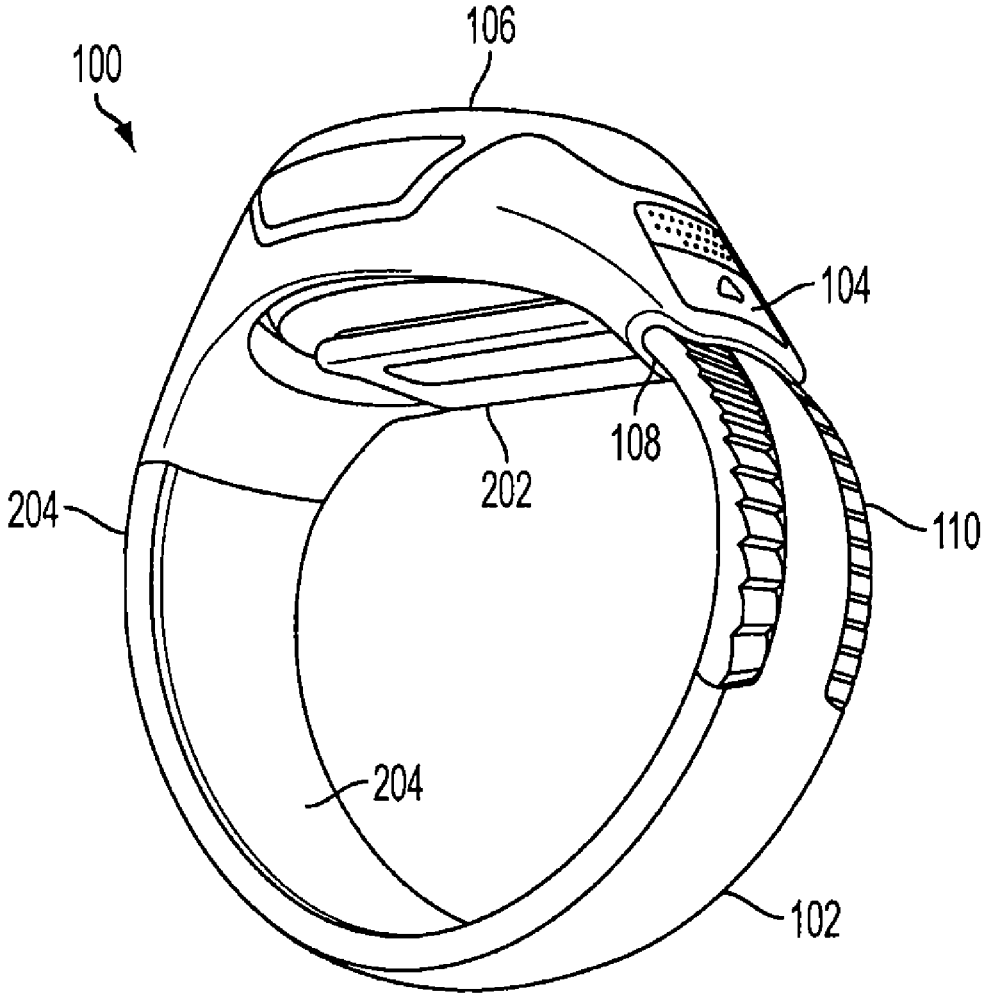
FIG. 2 is a perspective view of a watch having a strap closing system according to an embodiment of the invention.

FIG. 2 is a perspective view of a watch 100 having a strap closing system according to an embodiment of the invention. To close and secure the watch strap 102, a free end 202 of the watch strap 102 is inserted through the opening 108 in the watch housing 106 and is positioned below the watch housing 106. After the watch strap 102 has been adjusted to a desired constriction level around the user's wrist, the free end 202 remains flush with a bottom portion of the watch housing 106 or flush with the connected end 204 of the watch strap 102.

Figure 3:
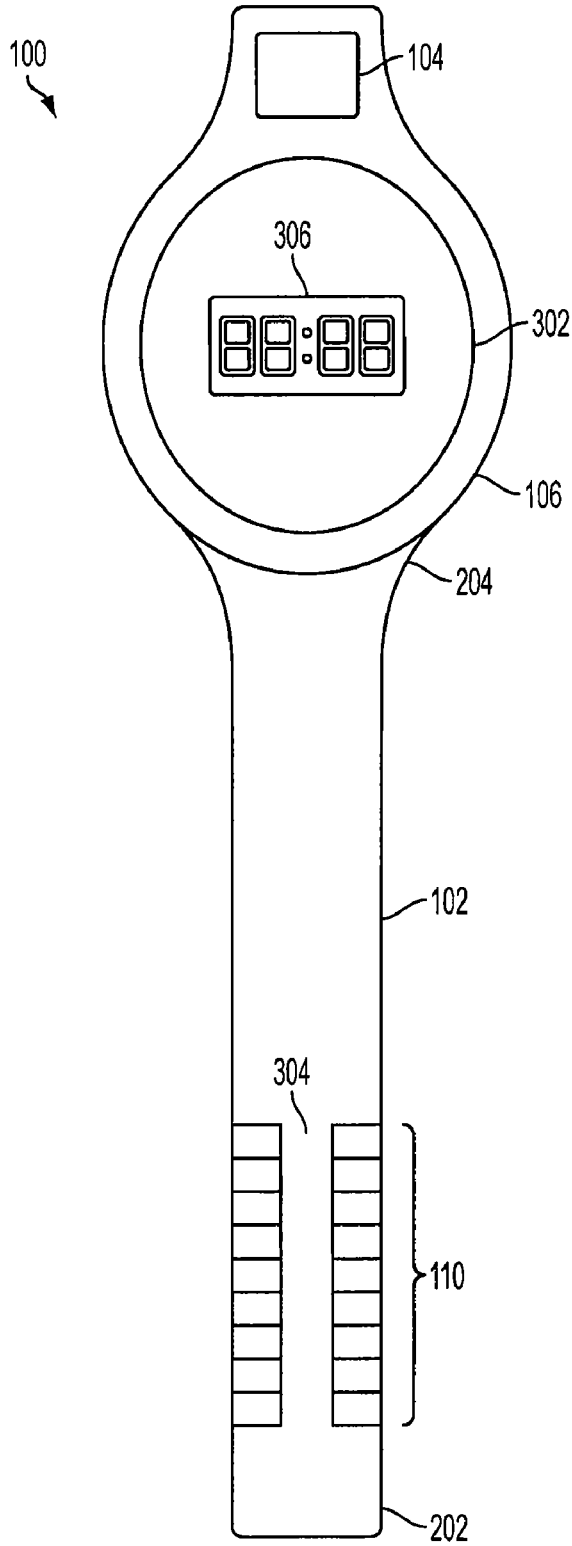
FIG. 3 is a top view of an unstrapped watch strap according to an embodiment of the invention.

FIG. 3 is a top view of an unstrapped watch strap according to an embodiment of the invention. In an embodiment, the watch strap 102 has a free end 202. The teeth 110 are positioned near the free end 110. The watch strap 102 can include any number of teeth 110, and can have only one tooth, or can include teeth along the entire length of the watch strap 102. In an embodiment, the teeth 110 are aligned along the edges of the free end 202 of the watch strap 102 so that there are two opposing rows of teeth with a smooth center channel 304. The center channel 304 does not contain any teeth 110. In another embodiment, the teeth 110 span the entire width (i.e., no smooth center channel 304) of the free end 202 of the watch strap 102.

In an embodiment, the watch housing 106 includes a top portion 302 with a display 306 that includes a digital time. In another embodiment, the watch housing 106 can include an analog time or a combination of a digital time and an analog time.

Figure 4:
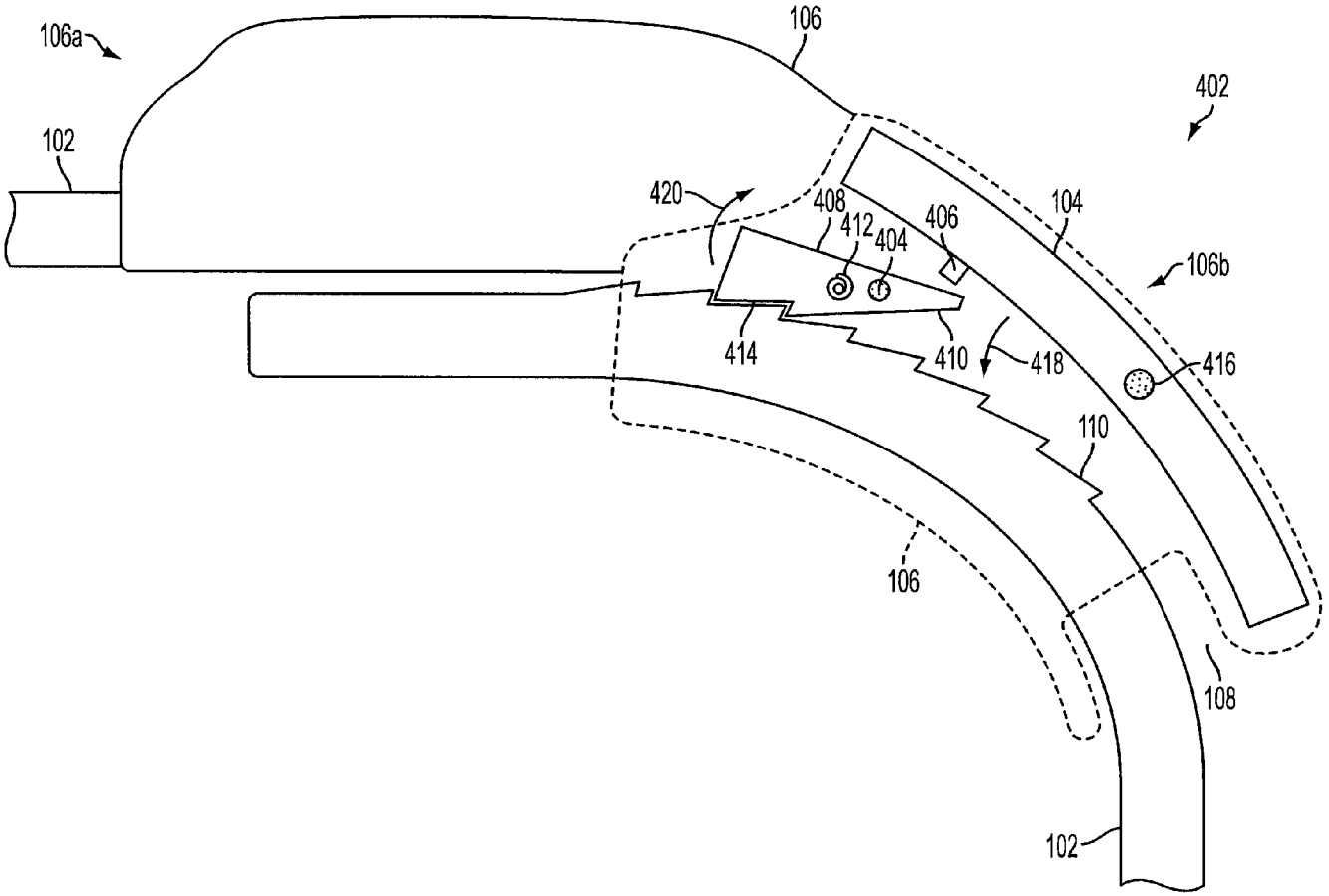
FIG. 4 is a cross-sectional view of a locking mechanism according to an embodiment of the invention.

FIG. 4 is a cross-sectional view of a locking mechanism 408 according to an embodiment of the invention. In an embodiment, the locking mechanism 408 is located within the watch housing 106 adjacent to the opening 108. The watch housing 106 has a first portion 106*a* and a second portion 106*b*. The locking mechanism 408 is integral with the second portion 106*b* of the watch housing 106. The locking mechanism 408, such as a wedge with a number of teeth protruding from the wedge, is mounted on a rod 404, which is attached to the watch housing 106. As shown, the rod 404 passes through the wedge and is attached to the watch housing 106. The locking mechanism 408 is pivotable about a horizontal axis centered at the rod 404, and is kept in place in an engaged position with watch strap 102 by a tension coil 412 mounted on the locking mechanism 408 and the rod 404. The tension coil 412 applies mechanical pressure to the locking mechanism 408 to cause the locking mechanism 408 to move towards and lock onto the watch strap 102. The tension coil 412 can by any type of spring, coil, or torsion bar that stores mechanical energy when it is twisted. The locking mechanism 408, in a locked position, is in contact with the watch strap 102. The locking mechanism 408, in an unlocked position, is not in contact with the watch strap 102.

In an embodiment, the locking mechanism 408 may have a dual set of teeth 414, which are interlocking members that are complimentary to the teeth 110 of the watch strap 102. The locking mechanism 408 can have a single tooth, or more than one tooth. As shown in FIG. 4, the locking mechanism 408 is engaged with the teeth 110. In the locked position, the tension coil 412 applies downward pressure to the locking mechanism 408 in a direction 418 toward the watch strap 102 which prevents the locking mechanism 408 from becoming disengaged from the teeth 110 of the watch strap 102.

To disengage the locking mechanism 408 from a locked position, the user depresses the depressable member 104, which is mounted on a rod 416 that is connected to the watch housing 106. The depressable member 104 is pivotable about a horizontal axis centered at the rod 416. Upon depression of the depressable member 104, a protrusion 406 is caused to come into contact with a front portion 410 of the locking mechanism 408. The pressure from the protrusion 406 causes the locking mechanism 408 to rotate about the rod 404 so that the front portion 410 of the locking mechanism 408 moves in a direction 418. This causes the teeth 414 of the locking mechanism 408 to disengage from the teeth 110 of the watch strap 102.

Figure 5:
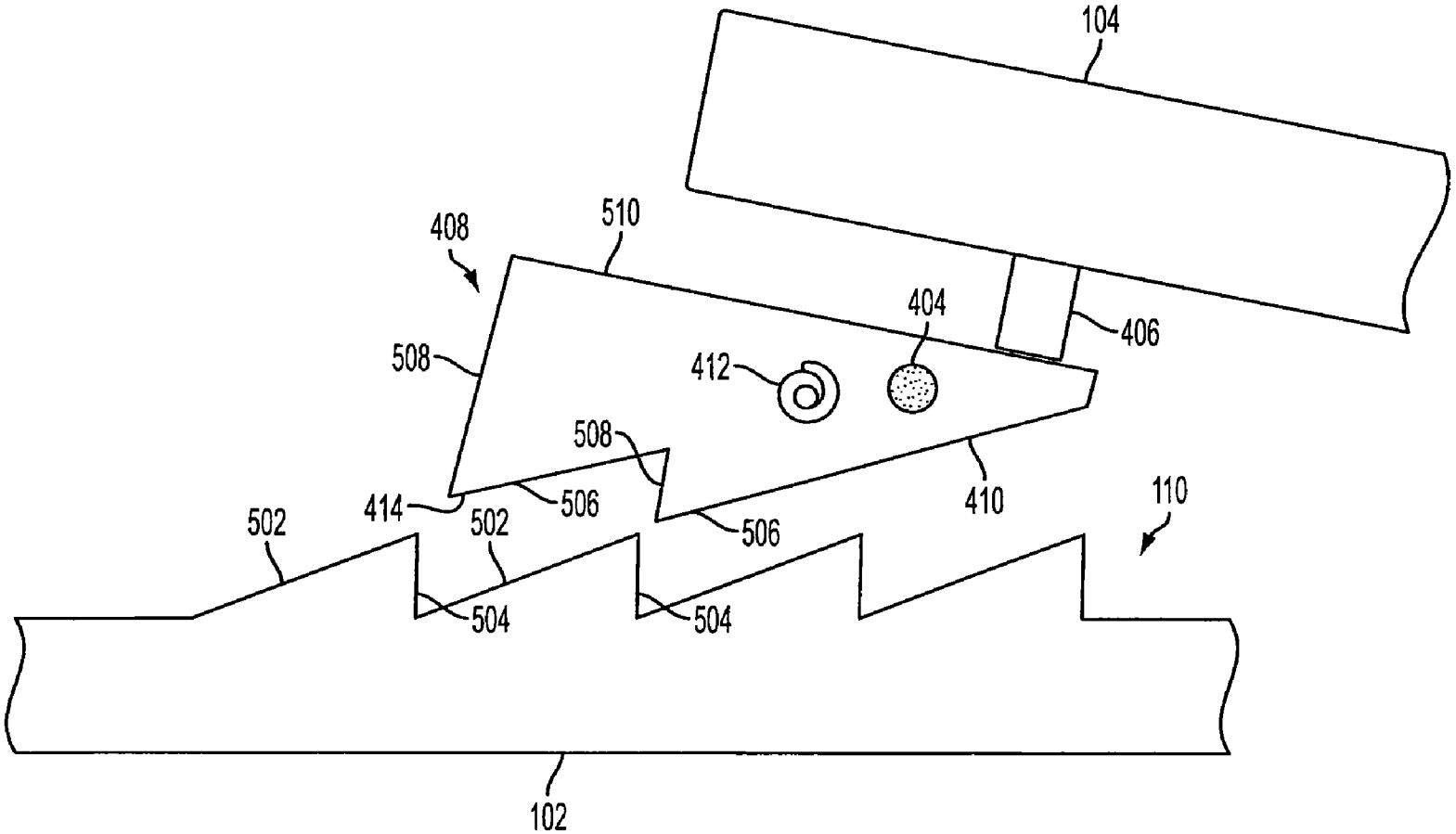
FIG. 5 is a cross-sectional view of an unengaged or unlocked locking mechanism according to an embodiment of the invention.

FIG. 5 is a cross-sectional view of an unengaged or unlocked locking mechanism according to an embodiment of the invention. As shown in FIG. 5, the rivet 406 is in contact with the front portion 410 of the locking mechanism 408, causing the locking mechanism 408 to rotate so that the teeth 414 of the locking mechanism 408 are no longer engaged with the teeth 110. When the depressable member 104 is no longer depressed, the rivet 406 is no longer in contact with the front portion 410 of the locking mechanism 408, thereby releasing pressure on the front portion 410 of the locking mechanism 408. The tension coil 412 causes the locking mechanism 408 to return to an engaged position with the teeth 110 of the watch strap 102.

In an embodiment, each tooth 110 of the watch strap 102 has a slanted portion 502 and a perpendicular portion 504 that is perpendicular to the watch strap 102. Similarly, each tooth 408 of the locking mechanism 408 has a slanted portion 506 and a perpendicular portion 508 that is perpendicular to a base 510 of the locking mechanism 408. In an embodiment, the teeth 110 of the strap 102 and the teeth 408 of the locking mechanism 408 are shaped in the form of saw-teeth. In another embodiment, the teeth of the strap 102 and locking mechanism 408 can be shaped as triangles, squares, half-circles, or any other geometric figure that allows the opposing set of teeth to be interlocked with one another.

In an embodiment, to adjust the watch strap 102, a user inserts the watch strap 102 through the opening 108 in the watch housing 106. As the watch strap 102 is pushed into the watch housing 106, the pressure from the watch strap 102 causes the locking mechanism 408 to move in an upward direction, allowing the teeth 110 of the watch strap 102 to pass under the locking mechanism 408. The constriction level of the watch strap 102 around the user's wrist corresponds to the number of teeth 110 that pass under the locking mechanism 408. Once a desired constriction level is reached, the watch strap 102 is no longer pushed into the watch housing 106, and the teeth 110 of the watch strap 102 become engaged to the teeth 414 of the locking mechanism 408. If pulling pressure is applied to the watch strap 102 in an effort to pull the watch strap 102 out of the opening 108, the locking mechanism 408 prevents the watch strap 102 from moving in a direction toward the opening 108. Pressure from tension coil 412 keeps the locking mechanism 408 engaged and prevents the teeth 414 of the locking mechanism 408 from moving in an upward direction away from the teeth 110 of the watch strap 102.

As described above, the locking mechanism 408 is disengaged from the watch strap 102 upon application of pressure on the depressable member 104, which causes the protrusion 406 to apply pressure to the front portion 410 of the locking mechanism 408, causing the locking mechanism 408 to rotate about the rod 404. While the depressable member 104 is depressed, the watch strap 102 can either be pulled out of the opening 102 if the user desires to loosen the watch strap 102 or remove the watch strap 102 from their wrist. Furthermore, while the depressable member 104 is depressed, the watch strap 102 can be pushed through the opening 108 and into the watch housing 106 to tighten the watch strap 102 around the user's wrist.

Figure 6:
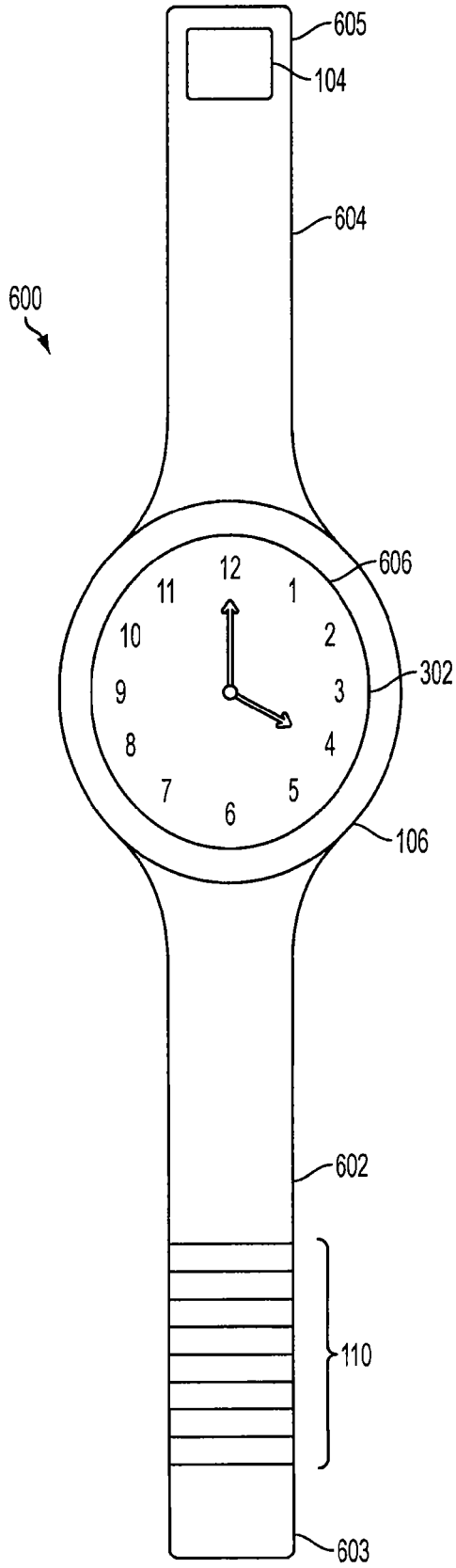
FIG. 6 is a top view of an unstrapped watch having dual straps according to an embodiment of the invention.

FIG. 6 is a top view of a watch having dual straps according to an embodiment of the invention. The watch 600 has a first strap 602 and a second strap 604. The first strap 602 has teeth 110 positioned near a first free end 603. The second strap 604 has a housing (not shown) and a depressable member 104 positioned near a second free end 605. The first strap 602 can include any number of teeth 110, and can have only one tooth, or can include teeth along a portion of or the entire length of the watch strap 102. In an embodiment, the teeth 110 span the entire width of the strap 602. In another embodiment, the teeth 110 can be positioned along opposite ends of the first free end 603 of the strap 602, and can include a smooth center channel similar to channel 304 shown in FIG. 3. In an embodiment, the watch housing 106 includes an analog display 606.

Figure 7:
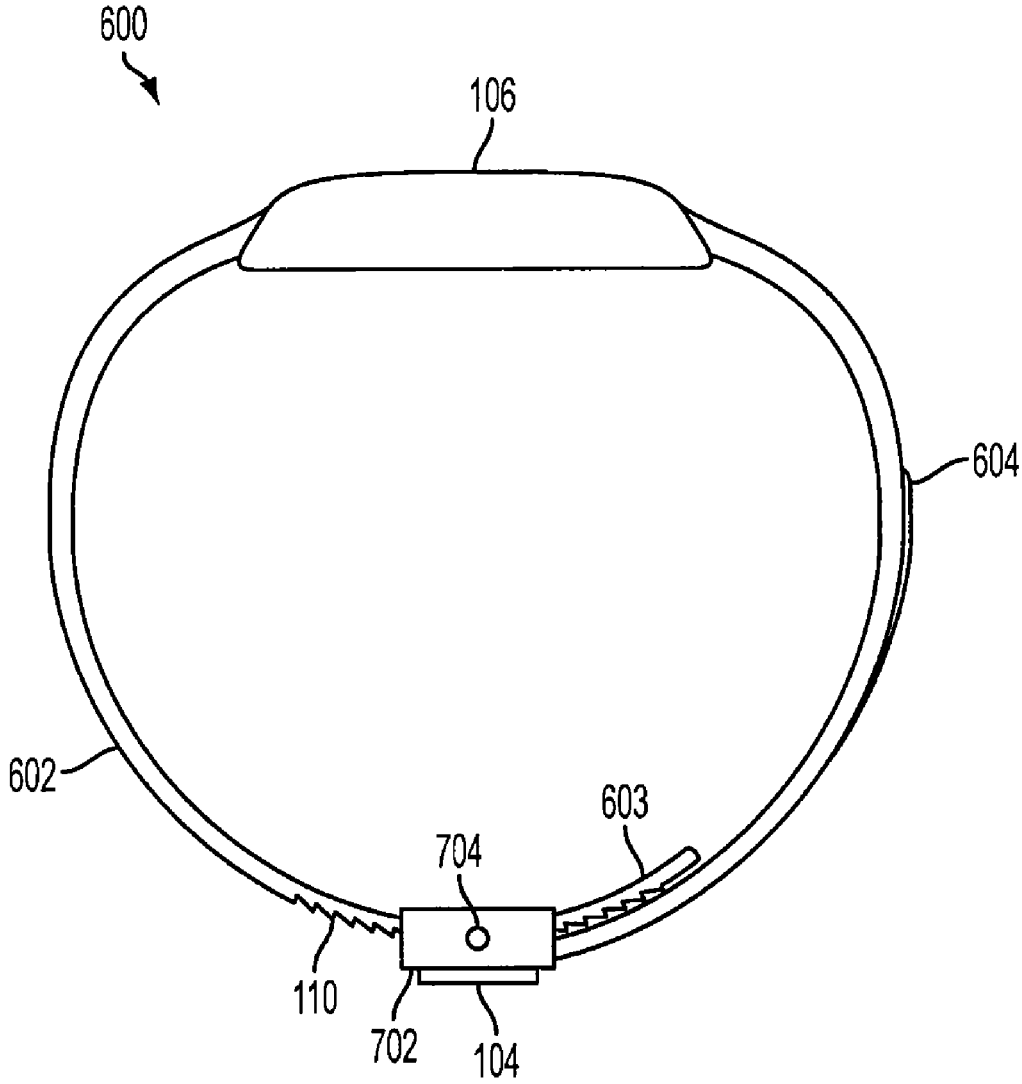
FIG. 7 is a side view of a strapped watch having dual straps according to an embodiment of the invention.

FIG. 7 is a side view of a strapped watch having dual straps according to an embodiment of the invention. A locking mechanism (not shown) is positioned within a watch strap connection box 702. The locking mechanism is similar to the locking mechanism 408 that is positioned within the watch housing 106 for the single strap watch embodiment described above. To position the watch 600 around the wrist, the first free end 603 of the first strap 602 is inserted into an opening (not shown) in the watch strap connection box 702. Once the first strap 602 has been adjusted to provide a desired level of constriction, the teeth 110 lock with complimentary teeth on the locking mechanism as described above. To remove or loosen the strap 602, the depressable member 104 can be depressed. In an embodiment, the watch strap connection box 702 can include a strap adjustment knob 704 that can be rotated to cause the first strap 602 to move further into or out of the watch strap connection box 702.

Figure 8:
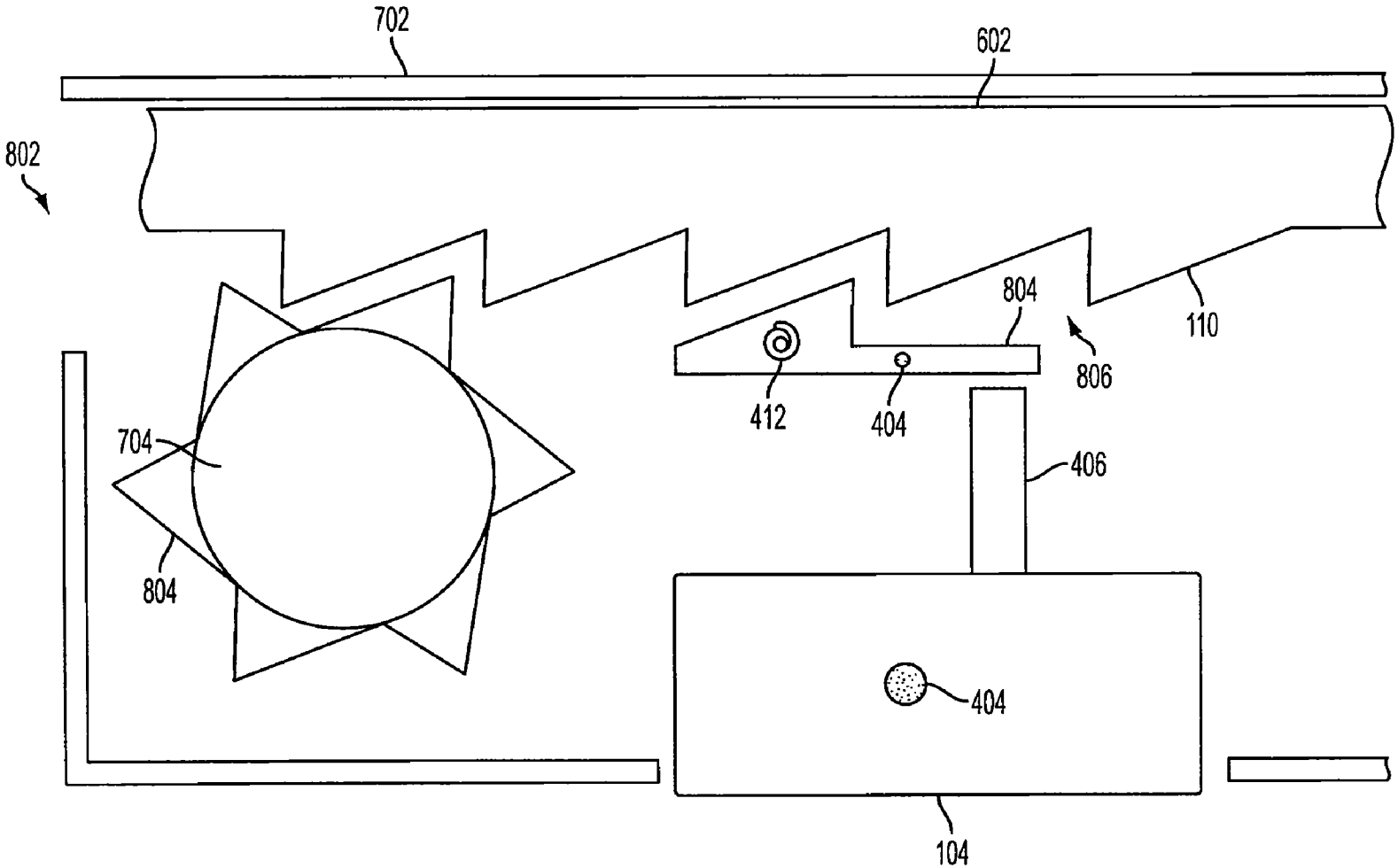
FIG. 8 is a cross-sectional view of a locking mechanism and strap adjustment knob according to an embodiment of the invention.

FIG. 8 is a cross-sectional view of a locking mechanism and strap adjustment knob according to an embodiment of the invention. The first strap 602 enters the watch strap connection box 702 through the opening 802 in the watch strap connection box 702. The knob 702 is mounted on a rod (not shown) that is attached to the watch strap connection box 702. In an embodiment, the rod can be an extension of the knob 704. The knob 704 includes teeth 804 that are complimentary to the teeth 110 on the first strap 602. Upon turning the knob 704, the teeth 804 engage with the teeth 110 on the first strap 602, causing the first strap 602 to move in the same direction as the knob 704 is turned.

In an embodiment, to increase the constriction level of the first strap 602, the knob 704 is turned in a clockwise direction, forcing the teeth 804 to push the first strap 602 further into the housing 602 in a direction toward the locking mechanism 408. To reduce the constriction level or to remove the first strap 602 from the housing, the knob 704 is turned in a counter-clockwise direction while the depressable member 104 is depressed. In another embodiment, the knob 704 and the locking mechanism 804 and/or the depressable member 104 can be coupled together, so that when the knob 704 is turned in a counter-clockwise direction, the locking mechanism 408 automatically disengages from the teeth 110 of the first strap 602. This eliminates the need for the depressable member 104 to be depressed in order to loosen or remove the first strap 602.

The locking mechanism 408 is pivotable about a horizontal axis centered at the rod 404, and is kept in place in an engaged position with watch strap 102 by the tension coil 412 mounted on the locking mechanism 408 and the rod 404. The tension coil 412 applies mechanical pressure to the locking mechanism 408 to cause the locking mechanism 408 to move towards and lock onto the first strap 602. The locking mechanism 408, in a locked position, is in contact with the first strap 602. The locking mechanism 408, in an unlocked position, is not in contact with the first strap 602.

Figure 9:
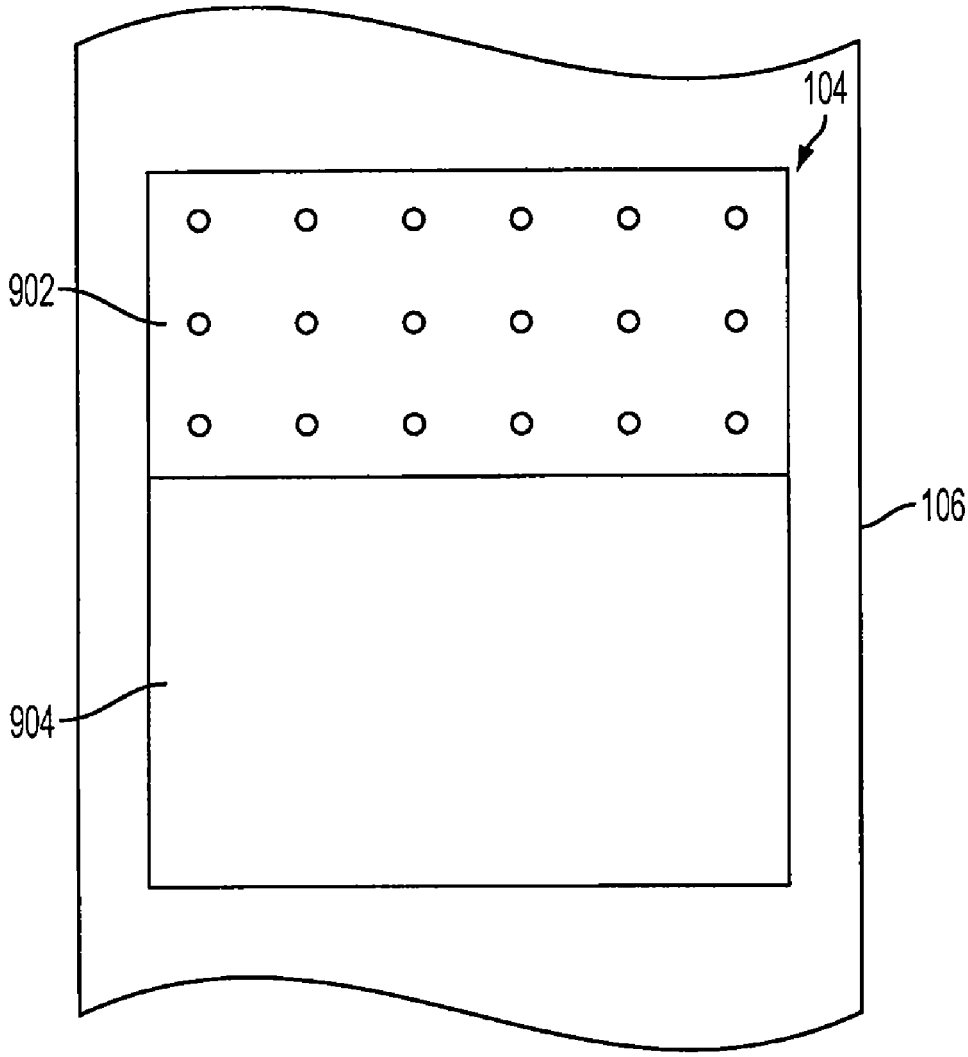
FIG. 9 is a top view of a depressable member according to an embodiment of the invention.

FIG. 9 is a top view of a depressable member according to an embodiment of the invention. In an embodiment, the depressable member 104 includes a tactile portion 902 and a non-tactile portion 904. The tactile portion 902 of the depressable member 104 is located above the protrusion 406 (on reverse side, not shown). Thus, applying pressure to the tactile portion 902 allows the protrusion 406 to come into contact with the front portion 404 of the locking mechanism 408. The tactile portion 902 provides an indication to the user of where to depress the depressable member 104. The tactile portion 902 can include, for example, grooves, bumps, ridges, cushioning, fabric, or any other material or pattern that provides a different feeling of touch than the non-tactile portion 904. In an embodiment, the non-tactile portion 904 is smooth to the touch of a user's finger.

Figure 10:
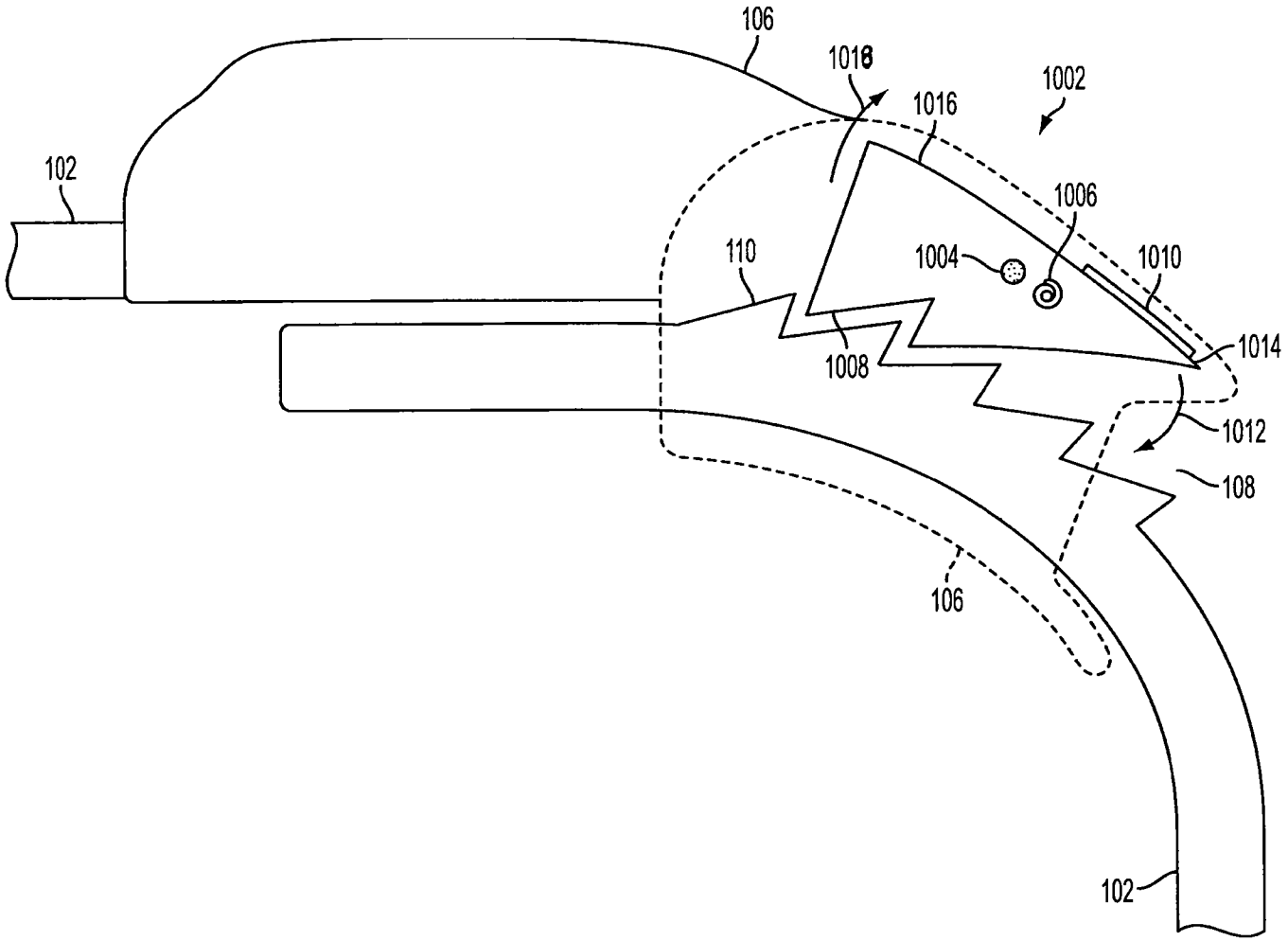
FIG. 10 is a view of a single-component locking mechanism according to an embodiment of the invention.

FIG. 10 is a view of a single-component locking mechanism according to an embodiment of the invention. In an embodiment, the locking mechanism 1002 is mounted within the watch housing 106 on a rod 1004. The locking mechanism 1002 is pivotable about a horizontal axis centered at the rod 1004, and is kept in place in a locked position with the watch strap 102 by a tension coil 1006 that is mounted on the locking mechanism 1002 and the rod 1004. In the locked position, the teeth 1008 of the locking mechanism 1002 lock with the teeth 110 of the watch strap 102. The tension coil 1006 allows the locking mechanism 1002 to automatically return to a locked position after it is depressed and in an unlocked position.

To unlock or disengage the locking mechanism 1002 from the watch strap 102, the locking mechanism 1010 can be depressed at a contact area 1010. When pressure is applied to the contact area 1010 by, for example, the user's finger, a contact end 1014 of the locking mechanism 1002 moves in a downward direction 1012 toward the watch strap 102, causing an engaged end 1016 of the locking mechanism 1002 to be in an unlocked position and move in an upward direction 1018 away from the watch strap 102. When the engaged end 1016 moves in an upward direction 1018, the teeth 1008 of the locking mechanism 1002 disengage from the teeth 110 of the watch strap 102, allowing the watch strap 102 to be adjusted, removed, tightened, or removed from the watch housing 106.

While the principles of the disclosure have been illustrated in relation to the exemplary embodiments shown herein, the principles of the disclosure are not limited thereto and include any modification, variation or permutation thereof.

What is claimed is:

1. A wristwatch, comprising:

a watch housing having a first portion, a second portion, and a top portion, the top portion having a time display, the second portion having an opening;

a watch strap having a first end and a second end, the first end connected to the first portion of the watch housing, the second end configured to be inserted through the opening in a first direction, the second end having a plurality of first interlocking members, wherein the first interlocking members include a plurality of opposing interlocking members with a smooth center channel substantially perpendicular to the opposing interlocking members and separating the opposing interlocking members; and a locking mechanism integral with the second portion of the watch housing, the locking mechanism pivotable between a locked position and an unlocked position, the locking mechanism having a plurality of second interlocking members configured to lock with the first interlocking members when the locking mechanism is in the locked position, the locking mechanism configured to prevent the second end of the watch strap from moving in a second direction opposite the first direction when the locking mechanism is in a locked position.

2. The wristwatch of claim 1, wherein the watch strap is made from rubber, plastic, or metal.

3. The wristwatch of claim 1, wherein the first interlocking members and the second interlocking members each have a saw-tooth shape.

4. The wristwatch of claim 1, wherein the watch strap and the watch housing are a single molded component.

5. The wristwatch of claim 1, wherein the locking mechanism includes a tension coil configured to prevent the second end of the watch strap from moving in a second direction opposite the first direction when the locking mechanism is in a locked position.

6. The wristwatch of claim 1, wherein the time display is a digital display.

* * * * *